United States Patent [19]

Tolfo et al.

[11] 4,287,082

[45] Sep. 1, 1981

[54] HOMOGENEOUS ENZYME-CONTAINING LIQUID DETERGENT COMPOSITIONS CONTAINING SATURATED ACIDS

[75] Inventors: Flavio Tolfo, Brussels; Christian R. Barrat, Meise, both of Belgium

[73] Assignee: The Procter & Gamble Company, Cincinnati, Ohio

[21] Appl. No.: 123,856

[22] Filed: Feb. 22, 1980

[51] Int. Cl.[3] ..... C11D 7/42

[52] U.S. Cl. ..... 252/174.12; 252/174.19; 252/174.21; 252/DIG. 12; 252/527; 252/540; 252/546; 252/559

[58] Field of Search ..... 252/174.12, 174.19, 252/174.21, DIG. 12, 527, 540, 546, 559; 424/94

[56] References Cited

U.S. PATENT DOCUMENTS

| | | | |
|---|---|---|---|
| 3,325,364 | 6/1967 | Merritt et al. | 252/174.12 |
| 3,557,002 | 1/1971 | McCarty | 252/174.12 |
| 3,676,374 | 7/1972 | Zaki et al. | 252/174.12 |
| 4,111,855 | 9/1978 | Barrat et al. | 252/174.12 |

*Primary Examiner*—Mayer Weinblatt

[57] ABSTRACT

Homogeneous aqueous enzyme-containing liquid detergent compositions containing substantial levels of saturated fatty acids, minute amounts of enzyme-accessible calcium, and additive levels of selected short chain carboxylic acids are disclosed. These compositions exhibit a broad range of stability benefits with respect to the activity of the individual ingredients as well as in respect to homegeneity.

9 Claims, No Drawings

HOMOGENEOUS ENZYME-CONTAINING LIQUID DETERGENT COMPOSITIONS CONTAINING SATURATED ACIDS

TECHNICAL FIELD

This invention relates to homogeneous enzyme-containing liquid detergent compositions containing substantial levels of saturated fatty acids. These compositions provide a series of remarkable stability benefits in respect to both functionality optimization of the individual ingredients and physical stability of the composition. More particularly, the compositions of this invention unexpectedly provide the cumulative benefits inherent to the presence of the detergent enzyme and to the substantial level of the saturated fatty acid.

There was a standing prejudice against the effective use of the like compositions, chiefly because of the contradictory behaviour of calcium in respect to saturated fatty acids and detergent enzymes.

It is well-known that enzyme-containing liquid detergent compositions require the presence of certain minimum levels of calcium as a primary stabilizing agent. This is especially applicable for proteolytic and amylolytic enzymes.

The liquid enzymatic detergent compositions of the prior art containing substantial levels of fatty acids and/or soaps are deficient with respect to important product characteristics. For example, the minimum level of calcium needed to provide acceptable enzymatic stability induces precipitation (in the liquid composition) in presence of substantial levels of saturated fatty acids and/or soaps. The like shortcomings can be overcome with the aid of known formulation changes inclusive of lowering the calcium level or using substantial levels of soluble calcium sequestrants. Both approaches can not be used in the context of this technology. The elimination or the substantial reduction of the calcium yields enzyme deactivation and instability upon aging. While the incorporation of strong sequestrants effectively cures the product instability, concurrently, it yields a substantial lowering of the enzymatic activity. These formulation constraints were such that it was not practically possible to simultaneously achieve product homogeneity, and effective enzyme stability in aqueous saturated fatty acid containing liquid detergents.

It was now found that the prior art shortcomings can be circumvented with the aid of a narrowly defined ternary combination, namely a saturated fatty acid, sub-minimum levels of enzyme-accessible calcium and a specific short-chain carboxylic acid to thus formulate substantially builder-free homogeneous enzyme-containing liquid detergents.

DESCRIPTION OF THE ART

The formulation of enzymatic aqueous detergent compositions containing substantial levels of saturated fatty acids/soaps is very difficult because of processing limitations and also because of the contradictory conditions under which saturated fatty acids/soaps and enzymes function in relation to calcium. While numerous attempts have been undertaken to formulate liquid detergent compositions allowing the simultaneous use of saturated fatty acids and/or soaps in combination with enzymes, success had not attended these efforts and no commercially-viable technology had been made available. U.S. Pat. No. 3,676,374, Zaki et al., discloses enzymatic detergent compositions on basis of a mixed sulfonate/nonionic/sulfate surfactant system and a proteolytic enzyme. Earth alkali-metal salts inclusive of calcium chloride, calcium acetate, magnesium chloride and magnesium acetate are recommended for stabilizing the enzymatic activity. Concentrated enzyme containing alkaline liquid detergents are also known from French Pat. No. 2,369,338. The active system of the '338 composition is comprised of a soap, a major amount of a nonionic ethoxylate and an anionic detergent. Comparable disclosures are known from French Pat. No. 2,389,672, namely alkaline liquid detergents containing a major amount of a soap and relatively low level of other organic surfactants and alkaline buffering agent. Liquid detergent compositions containing a combination of nonionic ethoxylates, soaps, amylolytic and/or proteolytic enzymes and alkoxylated alkylamines are also known from Belgian Pat. No. 857,144.

Thus while the individual ingredients of the claimed invention are conventional in liquid detergent technology there was a standing prejudice against using them concurrently; it was also not known that their combined use would provide significant benefits.

The present invention relates to novel enzymatic liquid detergent compositions containing substantial amounts of saturated fatty acids, a short chain carboxylic acid, and having a neutral pH.

DISCLOSURE OF THE INVENTION

The homogeneous aqueous detergent compositions of this invention comprise: (a) from about 20% to about 50% by weight of an organic synthetic surface-active agent; (b) from about 3% to about 15% by weight of a saturated fatty acid having 10 to 16 carbon atoms in the alkyl chain; (c) from 0.025% to about 1% by weight of an enzyme; (d) from 0.1% to about 3% by weight of a carboxylic acid having from 1 to 3 carbon atoms; and (e) less than 2 millimoles of enzyme-accessible calcium per kilo of the detergent composition, the pH of the composition measured as is at 20° C., being from about 6.5 to 8.5. In the preferred embodiments of this invention, the saturated fatty acids have from 12 to 14 carbon atoms in the alkyl chain, the detergent enzymes are represented by proteases or mixtures of proteases and amylases, the short chain carboxylic acid is represented by formic acid, the enzyme-accessible calcium is present in an amount of from about 0.5 to 1.5 millimoles per kilo of the detergent composition, and the pH of the composition, as is, is in the range from about 7 to about 7.5. The compositions of this invention are substantially builder free. While the fatty acids and/or soaps are not considered as detergent builders/sequestrants in the context of this invention, the claimed compositions do not contain more than minor amounts of sequestrants.

DETAILED DESCRIPTION OF THE INVENTION

Organic synthetic surface-active agents.

The organic synthetic surface-active agents can be selected from nonionic, anionic, cationic, zwitterionic, amphoteric, and semi-polar nonionic surfactants and mixtures thereof. While these surfactant components can be used over a wide concentration range, they are normally used in levels ranging from about 20% to about 50%.

Nonionic Surfactants.

The nonionic surfactants are conventionally produced by condensing ethylene oxide with a hydrocarbon having a reactive hydrogen atom, e.g., a hydroxyl, carboxyl, amino, or amido group, in the presence of an acidic or basic catalyst. Nonionic surfactants have the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms, but can also be formed by the condensation of propylene oxide with a lower molecular weight compound. n usually varies from about 2 to about 24.

The hydrophobic moiety of the nonionic compound is preferably a primary or secondary, straight or branched, aliphatic alcohol having from about 8 to about 24, preferably from about 12 to about 20 carbon atoms. A more complete disclosure of suitable nonionic surfactants can be found in U.S. Pat. No. 4,111,855 disclosed hereinbefore and incorporated herein by reference. Mixtures of nonionic surfactants can be desirable.

Anionic Surfactants.

Synthetic anionic surfactants can be represented by the general formula $R^1SO^3M$ wherein $R^1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt forming cation which typically is selected from the group consisting of sodium, potassium, ammonium, monoalkanolammonium, dialkanolammonium, trialkanolammonium and mixtures thereof.

A preferred synthetic anionic surfactant is a water-soluble salt of an alkylbenzene sulfonic acid containing from about 9 to about 15 carbon atoms in the alkyl group. Another preferred synthetic anionic surfactant is a water-soluble salt of an alkyl polyethoxylate ether sulfate wherein the alkyl group contains from about 8 to about 24, preferably from about 10 to about 18 carbon atoms and there are from about 1 to about 20, preferably from about 1 to about 12 ethoxy groups. Other suitable anionic surfactants are disclosed in U.S. Pat. No. 4,170,565, Flesher et al., issued Oct. 9, 1979, incorporated herein by reference.

Cationic Surfactants.

Suitable cationic surfactants have the general formula $R_m^2R_x^3Y_LZ$ wherein $R^2$ is an organic group containing a straight or branched alkyl or alkenyl group optionally substituted with up to three phenyl or hydroxy groups and optionally interrupted by up to four structures selected from the group consisting of

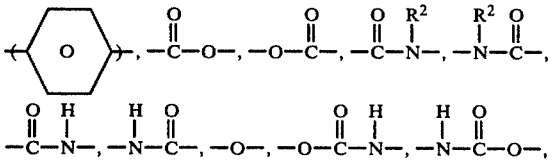

and mixtures thereof, each $R^2$ containing from about 8 to 22 carbon atoms, and which may additionally contain up to about 12 ethylene oxide groups, m is a number from 1 to 3, each $R^3$ is an alkyl or hydroxyalkyl group containing from 1 to 4 carbon atoms or a benzyl group with no more than one $R^3$ in a molecule being benzyl, x is a number from 0 to 11, the remainder of any carbon atom positions being filled by hydrogens, Y is selected from the group consisting of:

(1)

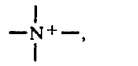

(2)

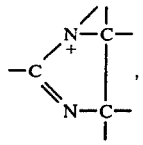

(3)

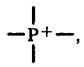

(4)

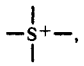

(5)

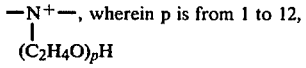

(6)

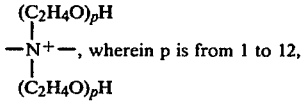

(7)

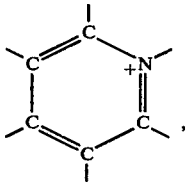

(8)

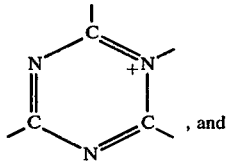

mixtures thereof. (9)

A more complete disclosure can be found in U.S. Pat. Application Ser. No. 919,340, by Cushman M. Cambre for Laundry Detergent Composition Having Enhanced Particulate Soil Removal and Antiredeposition Performance, filed June 26, 1978, said application being incorporated herein by reference. Care should be taken in including cationic materials, including surfactants since some cationic materials have been found to decrease enzyme effectiveness.

Zwitterionic Surfactants.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and one contains an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975, said patents being incorporated herein by reference.

Ampholytic Surfactants.

Ampholytic surfactants include derivatives of aliphatic heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

Semi-Polar Nonionic Surfactants.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures; water-soluble phosphine oxides containing one alkyl or hydroxy alkyl moiety of from about 8 to about 28 and two moieties selected from the group consisting of alkyl groups and hydroxy alkyl groups, containing from about 1 to about 3 carbon atoms and water-soluble sulfoxides containing one alkyl or hydroxy alkyl moiety of from about 8 to about 28 carbon atoms and a moiety selected from the group consisting of alkyl and hdryoxy alkyl moieties of from 1 to 3 carbon atoms.

For a more complete disclosure of compounds which are suitable for incorporation in detergent compositions, one can consult U.S. Pat. Nos. 4,056,481, Tate (Nov. 1, 1977); 4,049,586, Collier (Sept. 20, 1977); 4,040,988, Vincent et al. (Aug. 9, 1977); 4,035,257, Cherney (July 12, 1977); 4,033,718, Holcolm et al. (July 5, 1977); 4,019,999, Ohren et al. (Apr. 26, 1977); 4,019,998, Vincent et al. (Apr. 26, 1977); and 3,985,669, Krummel et al. (Oct. 12, 1976); all of said patents being incorporated herein by reference.

Preferred in the compositions of this invention is a binary active system consisting essentially of: an anionic synthetic surface-active salt selected from the group of sulfonates and sulfates and an ethoxylated nonionic surface-active agent, whereby the weight ratio of the anionic surface-active salt to the nonionic ethoxylate is generally in the range from 4:1 to 1:4 and more preferably in the range from 5:2 to 3:4.

Suitable anionic synthetic surface-active salts are selected from the group of sulfonates and sulfates. The like anionic detergents are eminently well-known in the detergent arts and have found wide-spread application in commercial detergents. Preferred anionic synthetic water-soluble sulfonate or sulfate salts have in their molecular structure an alkyl radical containing from about 8 to about 22 carbon atoms. Examples of such preferred anionic surfactant salts are the reaction products obtained by sulfating $C_8$—$C_{18}$ fatty alcohols derived from tallow and coconut oil; alkylbenzene sulfonates wherein the alkyl group contains from about 8 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880, incorporated herein by reference, can also be used. The neutralizing cation for the anionic synthetic sulfonates and/or sulfates is represented by conventional cations which are widely used in detergent technology such as sodium, potassium, lithium, amines and substituted amines. Preferred are sodium, mono-, di- and tri-ethanol amines.

A particularly preferred anionic synthetic surfactant component herein is represented by the water-soluble salts of an alkylbenzene sulfonic acid, preferably sodium or alkanolamine alkylbenzene sulfonates having from about 10 to 13 carbon atoms in the alkyl group.

A preferred class of nonionic ethoxylates is represented by the condensation product of a fatty alcohol having from 12 to 15 carbon atoms and from about 4 to 10 moles of ethylene oxide per mole of fatty alcohol. Suitable species of this class of ethoxylates include: the condensation product of $C_{12}$—$C_{15}$ oxo-alcohols and 7 moles of ethylene oxide per mole of alcohol; the condensation product of narrow cut $C_{14}$—$C_{15}$ oxo-alcohols and 7 or 9 moles of ethylene oxide per mole of fatty (oxo) alcohol; the condensation product of a narrow cut $C_{12}$—$C_{13}$ fatty (oxo) alcohol and 6.5 moles of ethylene oxide per mole of fatty alcohol; and the condensation products of a $C_{10}$—$C_{14}$ coconut fatty alcohol with a degree of ethoxylation (moles EO/mole fatty alcohol) in the range from 5 to 8. The fatty oxo alcohols while mainly linear can have, depending upon the processing conditions and raw material olefins, a certain degree of branching, particularly short chain such as methyl branching. A degree of branching in the range from 15% to 50% (weight %) is frequently found in commercial oxo-alcohols.

Preferred nonionic ethoxylated components can also be represented by a mixture of 2 separately ethoxylated nonionic surfactants having a different degree of ethoxylation. For example, the nonionic ethoxylate surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$—$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$—$C_{19}$ oxo-alcohol with more than 50% (wt) branching and from about 8 to 14 moles of ethylene oxide per mole of branched oxo-alcohol.

The Saturated Fatty Acid.

The saturated fatty acid component herein is incorporated in an amount of from about 3% to about 15%, preferably from about 5% to about 11%. The saturated fatty acids have from 10 to 16, preferably 12 or 14 carbon atoms in the alkyl chain. The most preferred fatty acids are either lauric acid or lauric and myristic fatty acid in a mixture of 5:1 to 1:1. It is understood that in addition to the saturated fatty acids, the compositions herein can comprise certain amounts of unsaturated fatty acids having, for example, 16 or 18 carbon atoms in the alkyl chain. Known examples of the like unsaturated fatty acids are oleic fatty acid and palmitoleic fatty acid.

The Enzyme.

The enzyme component herein is incorporated in an amount of from about 0.025 to about 1%, preferably from about 0.05% to about 0.2%. The preferred proteolytic enzyme component should give to the composition a proteolytic activity of at least about 4 Anson units, preferably from about 8 to about 30 Anson units, most preferably from about 10 to about 20 Anson units per kilo of the liquid detergent composition. In another preferred embodiment the enzyme component can be represented by a mixture of proteases and amylases. The proteolytic activity of that mixture is as defined hereinbefore.

Preferably the enzyme component is characterized by an isoelectric point of from about 8.0 to about 10, preferably from about 8.5 to about 9.5.

Examples of suitable proteolytic enzymes include many species which are known to be adapted for use in detergent compositions and, in fact, have been used in detergent compositions. Sources of the enzymes include commercial enzyme preparations such as "ALCALASE" sold by Novo Industries, and "MAXATASE" sold by Gist-Brocades, Delft, The Netherlands, which contain about 20% enzyme. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

A more complete disclosure of suitable enzymes can be found in U.S. Pat. No. 4,101,457, Place et al., issued July 18, 1978, incorporated herein by reference.

The Carboxylic Acid.

A further essential component herein is represented by a short chain carboxylic acid having from 1 to 3 carbon atoms. This ingredient is used in an amount from 0.1% to about 3%, preferably from 0.5% to 1.5% by weight. The carboxylic acid component can be represented by formic, acetic and propionic acid. Preferred are the water-soluble salts. Most preferred is formic acid or the formates such as sodium, potassium, lithium, amines and substituted amines, inclusive of mono-, di-, and tri-ethanolamines.

The Enzyme-Accessible Calcium.

The compositions herein comprise less than about 2, preferably from 0.5 to 1.5, millimoles of enzyme-accessible calcium per kilo of the homogeneous enzyme containing detergent product. The claimed compositions are substantially free of sequestrants, for example, polyacids capable of forming calcium complexes which are soluble in the composition. However, minor amounts of sequestrants such as polyacids or mixtures of polyacids can be used. The enzyme-accessible calcium is defined as the amount of calcium-ions effectively available to the enzyme component. The calcium sequestration resulting from e.g., 0.5% of a mixture of polyphosphonates and polyacids as exemplified hereinafter can represent about 1 to about 1.5 millimoles of calcium per kilo of product. The total calcium incorporated into the compositions is thus comprised of the enzyme-accessible calcium and also the calcium sequestered by the low levels of polyacids. From a practical standpoint the enzyme-accessible calcium is therefore the soluble calcium in the composition in the absence of any strong sequestrants, e.g., having an equilibrium constant of complexation with calcium equal to or greater than 1.5 at 20° C.

Product pH.

The pH of the product is from about 6.5 to about 8.5 preferably from about 7 to about 7.5 to obtain a combination of enzyme stability and detergency. Both high and low pH's can adversely affect enzyme stability.

Optional Components.

In addition to the essential ingredients described hereinbefore, the compositions herein frequently contain a series of optional ingredients which are used for the known functionality in conventional levels. While the inventive compositions are premised on aqueous enzyme-containing detergent compositions containing a critical ternary system as fully explained above, it is frequently desirable to use a phase regulant. This component together with water constitutes then the solvent matrix for the claimed liquid compositions. Suitable phase regulants are well-known in liquid detergent technology and, for example, can be represented by lower aliphatic alcohols having from 2 to 6 carbon atoms and from 1 to 3 hydroxyl groups, ethers of diethylene glycol and lower aliphatic monoalcohols having from 1 to 4 carbon atoms. Specific examples of phase regulants are: ethanol; n-propanol; isopropanol; butanol; 1,2-propanediol; 1,3-propanediol; n-hexanol; monomethyl-, -ethyl-, -propyl, and mono-butyl ethers and di-ethylene glycol. Additional phase regulants having a relatively high boiling point and low vapor pressure can also be used provided they do not react with the other ingredients of the compositions.

Known detergent hydrotropes are a further class of phase regulants suitable for use herein. Examples of these hydrotropes include salts of alkylarylsulfonates having up to 3 carbon atoms in the alkylgroup, e.g., sodium, potassium, ammonium and ethanolamine salts of xylene-, toluene-, ethylbenzene-, cumene-, and isopropylbenzene sulfonic acids. The phase regulant is frequently used in an amount from about 5% to about 20%; the sum of phase regulant and water is normally in the range from 65% to 35%.

The compositions herein can contain a series of further optional ingredients which are mostly used in additive levels, usually below about 5%. Examples of the like additives include: polyacids, suds regulants, opacifiers, antioxidants, bactericides, dyes, perfumes, brighteners and the like.

A preferred additive is represented by a polyacid or mixture of polyacids in an amount below about 1%. Suitable polyacids can include: citric, cyclohexane-1,1-dicarboxylic, cyclopropane-1,1-dicarboxylic, dimethylmalic, glutaric, o-hydroxybenzoic, m-hydroxybenzoic, p-hydroxybenzoic, itaconic, methylsuccinic, sodium tripolyphosphates, and nitrilotriacetic acid. Preferred polyacid species for use herein can be represented by citric acid and organo-phosphonic acids and mixtures thereof. Particularly preferred alkylene-polyaminopolyalkylene phosphonic acids are ethylene diamine tetramethylenephosphonic acid, hexamethylene diaminetetramethylenephosphonic acid, diethylene triaminepentamethylenephosphonic acid, and aminotrimethylenephosphonic acid or the salts thereof. These organophosphonic acids/salts are preferably used in an amount from 0.1%—0.8%.

The beneficial utilization of the claimed compositions under various usage conditions can require the utilization of a suds regulant. While generally all detergent suds regulants can be utilized preferred for use herein are alkylated polysiloxanes such as dimethylpolysiloxane also frequently termed silicones. The silicones are frequently used in a level not exceeding 0.5%, most preferably between 0.01% and 0.2%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The compositions herein can also contain known anti-oxidants for their known utility, frequently radical scavengers, in the art established levels, i.e. 0.001% to 0.25% (by reference to total composition). These anti-oxidants are frequently introduced in conjunction with the fatty acids. While many suitable antioxidants are readily known and available for that purpose especially preferred for use in the compositions herein are: 2,6 ditertiary butyl-p-cresol, more commonly known as butylated hydroxytoluene, BHT, and 2-tertiarybutyl-4-hydroxyanisole or 3-tertiarybutyl-4-hydroxyanisole more commonly known as BHA or butylated hydroxyanisole. Other suitable antioxidants are: 4,4'thiobis(6-tert-butyl-m-cresol) and 2-methyl-4,6-dinonyl phenol.

The following examples illustrate the invention and facilitate its understanding.

EXAMPLE

Liquid detergent compositions were prepared by mixing the listed ingredients in the stated proportions.

| INGREDIENTS | COMPOSITIONS A | B | C | I |
|---|---|---|---|---|
| Linear dodecylbenzene sulfonic acid | 14 | 14 | 14 | 14 |
| Condensation product of one mole of C13–C15 OXO alcohol and 7 moles of ethylene oxide | 30 | 15 | 15 | 15 |
| Lauric acid | — | 10 | 10 | 10 |
| Oleic acid | — | 5 | 5 | 5 |
| Triethanolamine | 8.5 | 5 | 5 | 5 |
| Sodium hydroxide to adjust pH to: | 7 | 7 | 7 | 7 |
| Ethanol | 10 | 10 | 10 | 10 |
| 1,2 propanediol | — | 4 | 4 | 4 |
| Proteolytic enzyme[a] | 0.05 | 0.05 | 0.05 | 0.05 |
| Calcium[b][c] | 4 | 4 | 2.0 | 2.0 |
| Sodium formate | — | — | — | 1.0 |
| Citric acid | 0.2 | 0.2 | 0.2 | 0.2 |
| Diethylenetriamine pentaphosphonic acid | 0.3 | 0.3 | 0.3 | 0.3 |
| Silicone suds regulant emulsion, brightener, perfume, opacifier, dye, antioxidant and water | BALANCE TO 100 | | | |

[a]MAXATASE® supplied by GIST-BROCADES expressed on a 100% active basis.
[b]Added as calcium chloride and expressed as millimoles of calcium ion per kilo of composition.
[c]The level of enzyme-accessible calcium is: composition A:2,5; B:2,5; C:0,5; and I:0.5.

The enzyme and physical stability of the listed compositions were determined under accelerated storage conditions after 2 weeks at 35° C. Composition A is representative of the prior art. Compositions B and C are reference compositions based on routine variations vs. the art compositions. Composition I is an example of the invention herein. The level of calcium in compositions A and B represents, based on current art knowledge, the minimum needed to achieve acceptable enzyme stability. The amount of calcium in composition C was lowered to the point where phase instability and precipitation would not anymore occur. The testing data are summarized below.

| | COMPOSITION A | B | C | I |
|---|---|---|---|---|
| Residual enzyme-Stability after 2 weeks at 35° C.(%) | 66 | 42 | 18 | 85 |

-continued

| | COMPOSITION A | B | C | I |
|---|---|---|---|---|
| Product appearance | precipitation | precipitation | clear | clear |

These results confirm the overall performance benefits provided by composition I in accordance with this invention vs. formulationwise closely related art composition —A— or what could be technical variations —B, C— of known art formulations.

Comparable performance benefits are obtained from the above compositions wherein the formic acid is replaced with an identical molar proportion of acetic acid or propionic acid.

Further compositions of this invention were prepared by mixing the listed components in the indicated proportions.

| INGREDIENTS | COMPOSITIONS D | II | III |
|---|---|---|---|
| Linear dodecylbenzene sulfonic acid | 14 | 14 | 14 |
| Condensation product of one mole of C13–C15 OXO alcohol with 35% of branching and 7 moles of ethylene oxide | 15 | 15 | 15 |
| Lauric acid | 10 | 10 | 10 |
| Oleic acid | 5 | 5 | 5 |
| Triethanolamine | 5 | 5 | 5 |
| Sodium hydroxide to adjust pH to: | 7 | 7 | 7 |
| Ethanol | 10 | 10 | 10 |
| 1,2 propylene glycol | 4 | 4 | 4 |
| Proteolytic enzyme[a] | 0.05 | 0.05 | 0.05 |
| Calcium[b] | 1.5 | 1.5 | 1.5 |
| Formic acid[c] | — | 0.68 | — |
| Acetic acid[c] | — | — | 0.88 |
| Citric acid | 0.2 | 0.2 | 0.3 |
| Diethanolamine pentaphosphonic acid | 0.3 | 0.3 | 0.3 |
| Silicone suds regulant emulsion, brightener, perfume, opacifier, dye, antioxidant and water | BALANCE TO 100 | | |

[a]MAXATASE® supplied by GIST-BROCADES and expressed on a 100% active basis
[b]Total calcium added as calcium chloride and expressed in millimoles of calcium ion per liter of solution.
[c]Equimolar quantities Composition D is what could be a technical variation of the state of art whereas formulae II and III are executions of the claimed invention.

The residual enzymatic activity (expressed in % of initial activity) were measured following exposure to accelerated storage conditions (48 hours at 40° C.).

The testing results were as follows:

| | Compositions D | II | III |
|---|---|---|---|
| Residual enzymatic activity (in %) | 25 | 64 | 48 |

These results verify the superiority of the claimed technology vs. closely related compositions and also show that formic acid is the most preferred short chain carboxylic acid.

A series of additional compositions of this invention are prepared by mixing the listed ingredients in a conventional manner.

| INGREDIENTS | COMPOSITIONS IV | V | VI | VII | VIII | IX | X |
|---|---|---|---|---|---|---|---|
| Linear dodecylbenzene sulfonic acid | 14 | 6 | 14 | 14 | 10 | 14 | 14 |
| Condensation product of one mole of C14–C15 OXO alcohol with 20% branching and 7 moles of ethylene oxide | 20 | 30 | — | — | — | 20 | — |
| Condensation product of one mole of C13–C15 OXO alcohol with 25% branching and 4 moles of ethylene oxide | — | — | — | 5 | — | — | — |
| Condensation product of one mole of C16–C19 OXO alcohol highly branched (60%) and 11 moles of ethylene oxide | — | — | — | 10 | — | — | — |
| Condensation product of one mole of C13–C15 OXO alcohol with 35% branching and 7 moles of ethylene oxide | — | — | 20 | — | 15 | — | 20 |
| Lauric acid | 10 | 10 | 5 | 5 | — | — | — |
| Coconut acid (hardened & stripped)[a] | — | — | — | — | 10 | 5 | 10 |
| Oleic acid | 5 | — | 8 | 8 | 5 | 10 | 5 |
| Proteolytic enzyme[b] | 0.05 | 0.05 | 0.05 | 0.05 | 0.05 | 0.05 | 0.05 |
| Calcium[c] | 1.5 | 2 | 1.6 | 2.0 | 1.5 | 0.5 | 1.0 |
| Sodium formate | 1.0 | 1.5 | 1.0 | 0.5 | 1.0 | 0.5 | 1.0 |
| Triethanolamine | 5 | 5 | 5 | 5 | 5 | 5 | 5 |
| Sodium hydroxide up to pH | 7 | 7 | 7 | 7.5 | 6.8 | 7 | 7 |
| Citric acid | 0.2 | 0.2 | 0.2 | 0.2 | 0.2 | 0 | 0 |
| Diethanolamine pentaphosphonic acid | 0.3 | 0.3 | 0.3 | 0.3 | 0.3 | 0 | 0.3 |
| Ethanol | 12 | 12 | 12 | 12 | 12 | 12 | 12 |
| Silicone suds suppressor emulsion, brightener, perfume, opacifier, dye, antioxidant and water | BALANCE TO 100 | | | | | | |

[a]Coconut fatty acid having a ratio : lauric to myristic acid of 70 to 30.
[b]MAXATASE® supplied by GIST-BROCADES expressed on 100% active enzyme-basis.
[c]Total calcium is expressed as millimoles of calcium per kilo of composition and added as calcium chloride.

Compositions IV–X are clear, homogeneous products having a markedly improved enzyme stability, especially upon storage.

We claim:

1. A homogeneous aqueous liquid detergent composition consisting essentially of:

(a) from about 20% to about 50% by weight of organic synthetic surface-active agent selected from the group consisting of anionic and nonionic surfactants;

(b) from about 3% to about 15% by weight of saturated fatty acid having from 12 to 14 carbon atoms in the alkyl chain;

(c) from 0.04% to 0.4% by weight of enzyme selected from the group consisting of proteases and mixtures of proteases and amylases;

(d) from 0.1% to 3% by weight of carboxylic acid or salt thereof selected from the group consisting of acetic acid, formic acid and sodium formate;

(e) from 0.5 to 1.5 millimoles per kilo of the detergent composition of enzyme-accessible calcium; the pH of the composition, measured at 20° C., being from 6.5 to 8.5.

2. The composition in accordance with claim 1 which in addition contains a phase regulant in an amount from about 5% to about 20% by weight.

3. The composition in accordance with claim 1 which in addition contains from 0.01% to 0.2% by weight of a silicone suds-regulant.

4. The composition in accordance with claim 1 which in addition contains up to 1% by weight of a polyacid selected from the group consisting of: citric acid, alkylene-polyaminopolyalkylene phosphonic acids and mixtures thereof.

5. The composition in accordance with claim 4 wherein the alkylene-polyamino-polyalkylene phosphonic acid is selected from the group consisting of ethylenediaminetetramethylene phosphonic, hexamethylenediamine tetramethylene phosphonic, diethylenetriaminepentamethylene phosphonic and aminotrimethylenephosphonic acids and the salts thereof and is present in an amount of from 0.1% to 0.8% by weight.

6. The composition in accordance with claim 1, in which component (d) is sodium formate.

7. The composition in accordance with claim 6, in which component (b) is lauric acid.

8. The composition in accordance with claim 6 which contains coconut oil fatty acid as the source of $C_{12}$ and $C_{14}$ saturated fatty acids.

9. The composition in accordance with claim 6, in which component (b) is present at a level of from about 5% to about 11% by weight, in which component (d) is present at a level of from 0.5% to 1.5% by weight, and in which the pH of the composition ranges from about 7 to 7.5.

* * * * *